US012054921B2

(12) United States Patent
Bjerke et al.

(10) Patent No.: US 12,054,921 B2
(45) Date of Patent: Aug. 6, 2024

(54) CORNER GUARD FOR A WORK IMPLEMENT ASSEMBLY

(71) Applicant: Caterpillar Inc., Peoria, IL (US)

(72) Inventors: Nathan R. Bjerke, Peoria, IL (US); Michael Tancin, Valentine (AU); Eric Thomas Sinn, Tremont, IL (US)

(73) Assignee: Caterpillar Inc., Peoria, IL (US)

( * ) Notice: Subject to any disclaimer, the term of this patent is extended or adjusted under 35 U.S.C. 154(b) by 201 days.

(21) Appl. No.: 17/338,025

(22) Filed: Jun. 3, 2021

(65) Prior Publication Data

US 2022/0389690 A1 Dec. 8, 2022

(51) Int. Cl.
*E02F 9/28* (2006.01)

(52) U.S. Cl.
CPC ..... *E02F 9/2883* (2013.01); *E02F 9/2858* (2013.01)

(58) Field of Classification Search
CPC ..... E02F 9/2858; E02F 9/2883; E02F 9/28; E02F 9/2808; E02F 9/2816
See application file for complete search history.

(56) References Cited

U.S. PATENT DOCUMENTS

| | | | | |
|---|---|---|---|---|
| 2,732,639 | A * | 1/1956 | Lillengreen | E02F 3/8152 172/701.2 |
| 4,086,967 | A * | 5/1978 | Eftefield | E02F 3/8152 172/701.2 |
| T973,002 | I4 | 8/1978 | Klett | |
| D458,614 | S | 6/2002 | Esterhuyse et al. | |
| 6,457,269 | B1 | 10/2002 | Esterhuyse et al. | |
| 7,266,914 | B2 | 9/2007 | Grant | |
| 9,556,595 | B2 * | 1/2017 | Biggs | E02F 9/2875 |
| 9,593,470 | B2 | 3/2017 | Dallard et al. | |
| 9,725,875 | B2 * | 8/2017 | Congdon | E02F 9/2858 |
| 9,758,947 | B2 | 9/2017 | Serrurier et al. | |
| 10,208,452 | B2 | 2/2019 | Kunz | |
| D873,306 | S | 1/2020 | Bjerke et al. | |
| D882,644 | S | 4/2020 | Bjerke et al. | |
| D882,645 | S | 4/2020 | Bjerke et al. | |
| D882,646 | S | 4/2020 | Bjerke et al. | |

(Continued)

FOREIGN PATENT DOCUMENTS

| | | | |
|---|---|---|---|
| AU | 2010100656 | A4 | 7/2010 |
| WO | 2011156834 | A1 | 12/2011 |

(Continued)

OTHER PUBLICATIONS

Chilean 2nd Substantive Report for Chile Patent Appln. No. 2021-003188, mailed Jun. 1, 2023 (16 pgs).

(Continued)

*Primary Examiner* — Adam J Behrens
*Assistant Examiner* — Blake E Scoville

(57) ABSTRACT

A corner guard includes a rear attachment portion defining a first fastener receiving void, a rear edge that is disposed along the direction of material flow, and a forward ramp portion that extends forwardly from the rear attachment along the direction of material flow, and vertically downwardly forming a front wear edge. The corner guard also includes an outer lateral side, and an inner lateral side. The outer lateral side is flared laterally, defining an outer lateral side extremity that is disposed along the direction of material flow adjacent to the front wear edge, forming a flared portion.

18 Claims, 10 Drawing Sheets

(56) References Cited

U.S. PATENT DOCUMENTS

| | | | | |
|---|---|---|---|---|
| 10,774,499 | B2 | 9/2020 | Olinger, IV et al. | |
| D901,550 | S | 11/2020 | Bjerke et al. | |
| D901,551 | S | 11/2020 | Bjerke et al. | |
| D901,552 | S | 11/2020 | Bjerke et al. | |
| D927,561 | S | 8/2021 | Bjerke et al. | |
| D928,848 | S | 8/2021 | Bjerke et al. | |
| D928,849 | S | 8/2021 | Bjerke et al. | |
| D952,697 | S | 5/2022 | Bjerke et al. | |
| 2014/0173949 | A1 | 6/2014 | Karlsson et al. | |
| 2015/0211215 | A1* | 7/2015 | Dallard ..... | E02F 9/2858 37/448 |
| 2020/0199854 | A1 | 6/2020 | Ames et al. | |

FOREIGN PATENT DOCUMENTS

| | | | |
|---|---|---|---|
| WO | 2017075663 | | 5/2017 |
| WO | WO-2017075663 | A1 * | 5/2017 |
| WO | 2021221803 | | 11/2021 |

OTHER PUBLICATIONS

Chile Patent Office Action for Chile Patent Appln. No. 2021-3188, mailed Feb. 13, 2023 (14 pgs).
European Union Trademark Application No. EM008748016-0001, published Nov. 23, 2021, (3 pgs).

* cited by examiner

CORNER GUARD FOR A WORK IMPLEMENT ASSEMBLY

TECHNICAL FIELD

The present disclosure relates to work implement assemblies such as bucket assemblies used by earth moving, mining, construction equipment and the like. More specifically, the present disclosure relates to such assemblies that employ corner guards that are used in various mining applications.

BACKGROUND

Machines such as wheel loaders, excavators, and the like employ work implement assemblies including bucket assemblies, rakes, shears, etc. that have teeth or tips attached to them to help perform work on a material such as dirt, rock, sand, etc. For example, teeth or tips may be attached to a bucket assembly to help the bucket assembly to penetrate the ground, facilitating the scooping of the dirt into a bucket. Adapters are often attached to the work edges (e.g. the base edge, the side edge, etc.) of the bucket or other work implement so that different styles of teeth or tips may be attached to the work implement. In addition to or in lieu of these tips, various guards may be employed that protect the base edge of a bucket assembly or the like in order to prolong the useful life of the base edge.

More specifically, in some applications a wheel loader may be employed that uses a bucket assembly to remove material. While the right hand corner guard may be visible to the operator, the left hand corner guard may not be as visible. As a result, the operator may more easily remove material on the right side of the bucket assembly without repeatedly grinding the corner guard on a wall, as compared to the left side. Over time, the repeated inadvertent grinding of the left hand corner guard against a wall may require that the left hand corner guard be replaced more often than the right hand corner guard. Thus, the left hand corner guard may set the maximum amount of time a bucket assembly may be used before maintenance is required.

U.S. Pat. No. 9,593,470 B2 discloses a corner guard that has a first portion, a second portion, and an intermediate portion between the first and the second portions, all in different planes to one another. A boss or lug is provided on the leading edge of the intermediate portion. The intermediate portion is angled relative to both the first and the second portions, which alleviates the load stresses otherwise created in a traditional 90 degree corner. The first portion has a wall with a taper or bevel towards a forward edge. The second portion has a wall with a leading flared wall portion that widens the corner at the front. The intermediate portion is preferably at an included angle of around 120 degrees to 170 degrees with respect to the respective walls of the first and the second portions.

The '470 patent fails to address the wear issues as described herein, instead focusing on stresses exerted on the corner of the bucket assembly as it is used. So, there is a need for a corner guard that is more resistant to wear than previously designed.

SUMMARY OF THE DISCLOSURE

A corner guard for protecting a base edge according to an embodiment of the present disclosure may comprise a rear attachment portion defining a first fastener receiving void, a vertical direction of assembly, a lateral direction that is perpendicular to the vertical direction of assembly, and a direction of material flow that is perpendicular to the vertical direction of assembly and the lateral direction. The corner guard may also include a rear edge that is disposed along the direction of material flow, and a forward ramp portion that extends forwardly from the rear attachment portion along the direction of material flow, and vertically downwardly forming a front wear edge. The corner guard may also comprise an outer lateral side, and an inner lateral side. The outer lateral side may be flared laterally, defining a lateral side extremity that is disposed along the direction of material flow adjacent to the front wear edge.

A corner guard for protecting a base edge according to another embodiment of the present disclosure may comprise a rear attachment portion defining a first fastener receiving void, a vertical direction of assembly, a lateral direction that is perpendicular to the vertical direction of assembly, and a direction of material flow that is perpendicular to the vertical direction of assembly and the lateral direction. The corner guard may also include a rear edge that is disposed along the direction of material flow, a forward ramp portion that extends forwardly from the rear attachment portion along the direction of material flow, and vertically downwardly forming a front wear edge, an outer lateral side, and an inner lateral side. The outer lateral side may be flared laterally, and enlarged vertically from the rear edge toward the front wear edge, forming a front flared portion disposed proximate to the front wear edge, and a defining a flat bottom surface and a flat top surface disposed proximate to a front corner of the corner guard.

A corner guard for protecting a base edge according to yet another embodiment of the present disclosure may comprise a rear attachment portion defining a first fastener receiving void, a vertical direction of assembly, a lateral direction that is perpendicular to the vertical direction of assembly, and a direction of material flow that is perpendicular to the vertical direction of assembly and the lateral direction. The corner guard may include a rear edge disposed along the direction of material flow, a forward ramp portion that extends forwardly from the rear attachment portion along the direction of material flow, and vertically downwardly forming a front wear edge, and an outer lateral side as well as an inner lateral side. The front wear edge may extend laterally, and may further comprise a flat bottom surface that extends from the outer lateral side toward the inner lateral side, and a bottom sloping surface that extends from adjacent the flat bottom surface laterally toward the inner lateral side.

DETAILED DESCRIPTION

Figure 1:
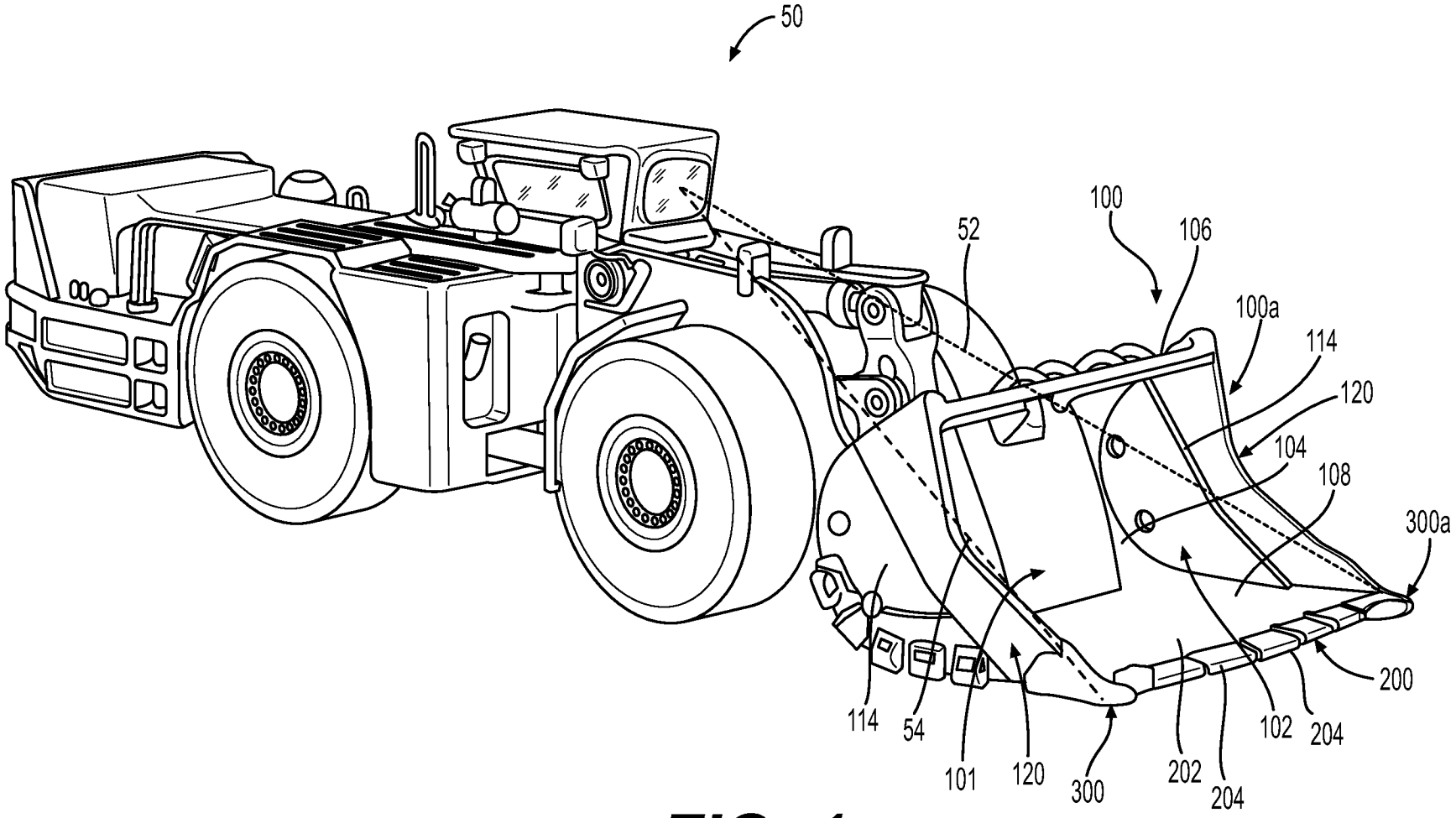
FIG. 1 illustrates a wheel loader used in underground mining applications that may use a bucket assembly. The right hand corner guard is visible to the operator, while the left hand corner is not easily visible to the operator, leading to grinding of the left hand corner guard against a wall of the mine.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function such as is often the case when geometry is mirrored about a plane of symmetry. For ease of explanation in this specification, letters or primes will often not be included herein but may be shown in the drawings to indicate duplications of features discussed within this written specification.

A corner guard that may last longer despite inadvertent scraping in underground mining applications will be discussed momentarily herein with regard to a specific application. In particular, the corner guard may take the form of a left corner guard for reasons set forth above herein. However, it is to be understood that the corner guard could also be a right corner guard (e.g., may be symmetrically configured to the left corner guard). Also, it is to be understood that the corner guard may be used on various work implement assemblies in other applications such as above ground mining, excavation, earth moving, and construction, etc.

Figure 2:
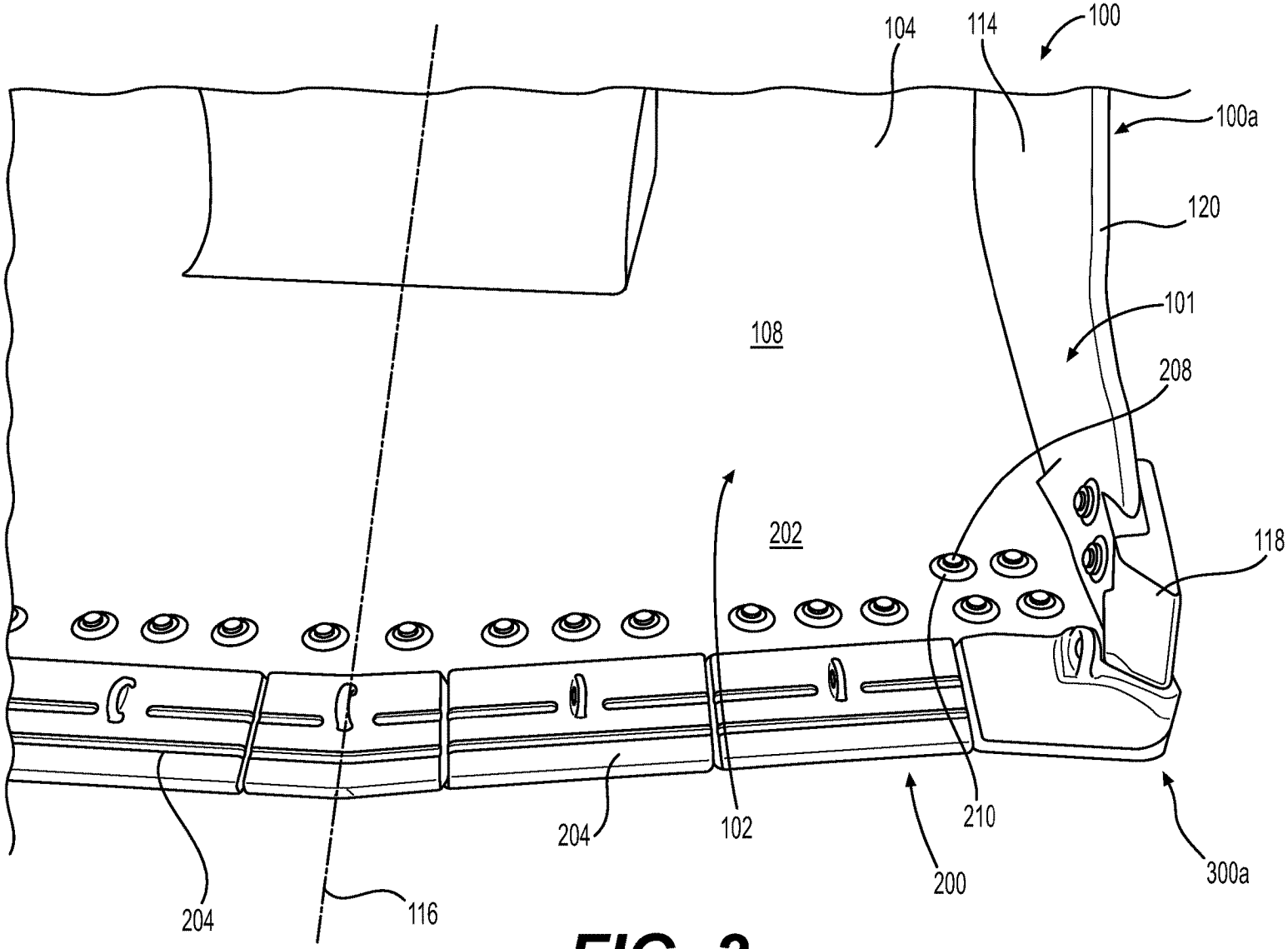
FIG. 2 is a front view of the wheel loader of FIG. 1, showing the right half of the bucket assembly including the right hand corner guard that is configured according to an embodiment of the present disclosure.

Starting with FIGS. 1 and 2, a machine 50 such as a wheel loader (may have a low profile) or the like may use a work implement assembly 100 that may take the form of a bucket assembly 100*a* that includes an enclosure 101 that defines an opening 102 that communicates with a generally enclosed interior. Starting from the rear of the bucket assembly 100*a*, the bucket assembly 100*a* includes a curved shell profile 104, which is attached to a top wall 106 at the top end of the shell 104. The other end of the shell is attached to the bottom plate 108 of the assembly 100*a*. Two substantially flat end plates 114 are attached to the side edges of the top plate 106, bottom plate 108 and shell 104. One more side guards 118 and side cutters 120 may be provided.

A front edge assembly 200 may be attached to the bucket assembly. This front edge assembly may include a base edge 202 (may also be referred to as a front lip), a plurality of center guards 204, a left corner guard 300, and a right corner guard 300*a*. The guards may be attached to the base edge 202 via a plurality of nuts 206, and bolts 208.

In FIG. 1, it can be seen the right corner guard has an unobstructed sight line 52, while the left corner guards has an obstructed sight line 54 as previously alluded to herein. So, the left corner guard may be subjected to more abrasion than the right corner guard.

Again, it is to be understood the work implement assembly may take other forms other than a bucket assembly including rake assemblies, shear assemblies, etc. Also, any of the embodiments of the cutting edge tips may be used in any of these other forms of work implement assemblies including other differently configured bucket assemblies. Other machines may use the corner guard(s) including skid steers, bulldozers, excavators, mining shovels, etc.

Before focusing on the left corner guard, the Applicant points out that FIG. 2 shows a plane of symmetry 116 (e.g. may be a lateral midplane) for the bucket assembly 100*a* indicating that the left and right corner guards may be symmetrically configured to each other. So, while the figures focus on features of the left corner guard, the wording of this written description as well as of the claims also apply equally to a right corner guard.

Figure 3:
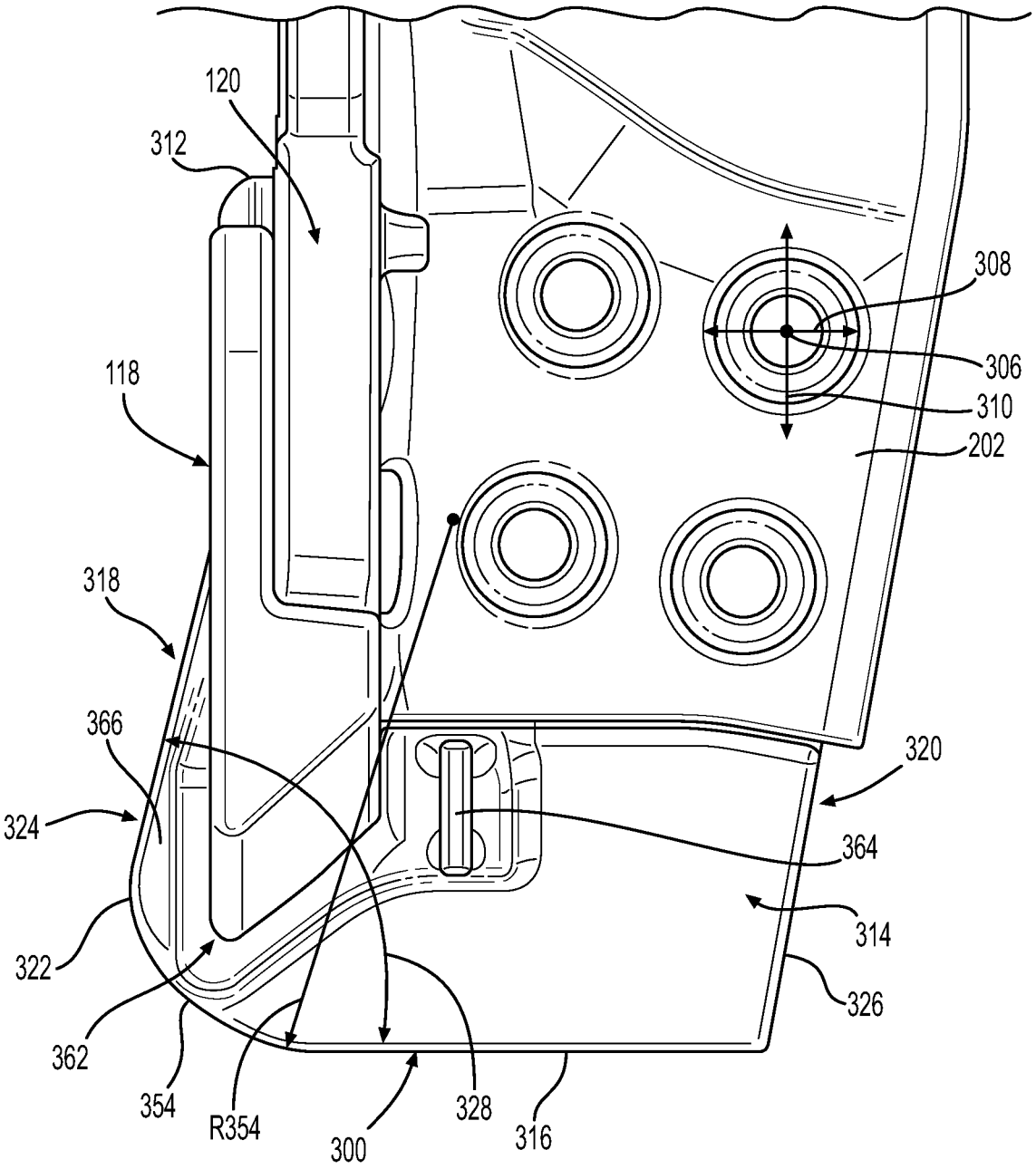
FIG. 3 is a top view, showing the mating of the left side guard, and the left hand corner guard that may be used in the bucket assembly of FIG. 1.
Figure 4:
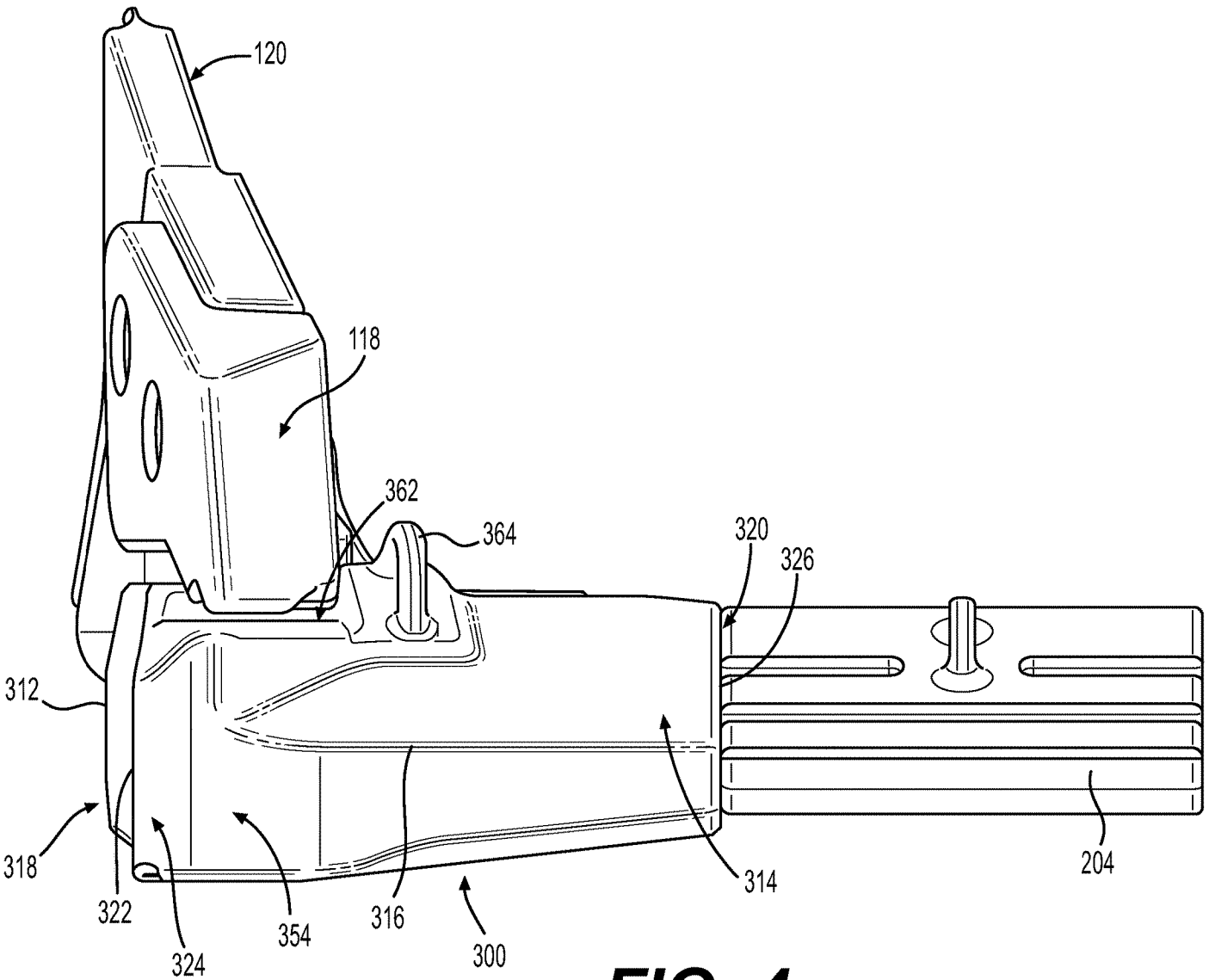
FIG. 4 is a front view of the left side guard, and left hand corner guard of FIG. 3, as well as a center guard that is disposed to the right side of the left hand corner guard.

In FIGS. 3 and 4, the left side components of the bucket are shown in more detail, revealing how they mate with each other more clearly. A side guard rests 118 on top of the corner guard 300, while a center guard 204 abuts the inner lateral side 320 of the corner guard 300. The fastener receiving apertures of the side guard (or possibly the base edge 202 as shown) are in alignment with those of the corner guard 300 so that the components may be fastened together.

Figure 5:
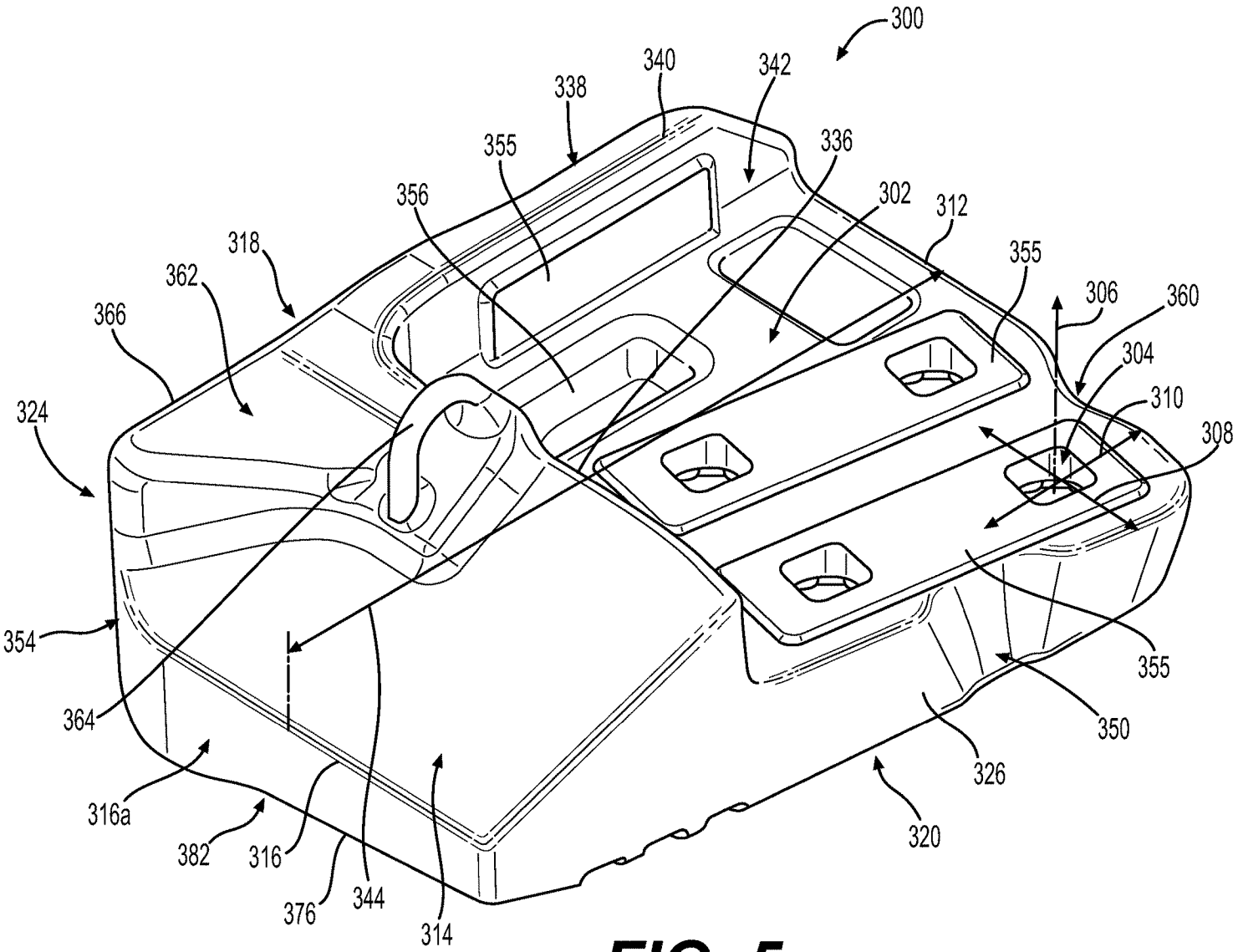
FIG. 5 is a right side, and top oriented perspective view of the left hand corner guard of FIG. 3.
Figure 6:
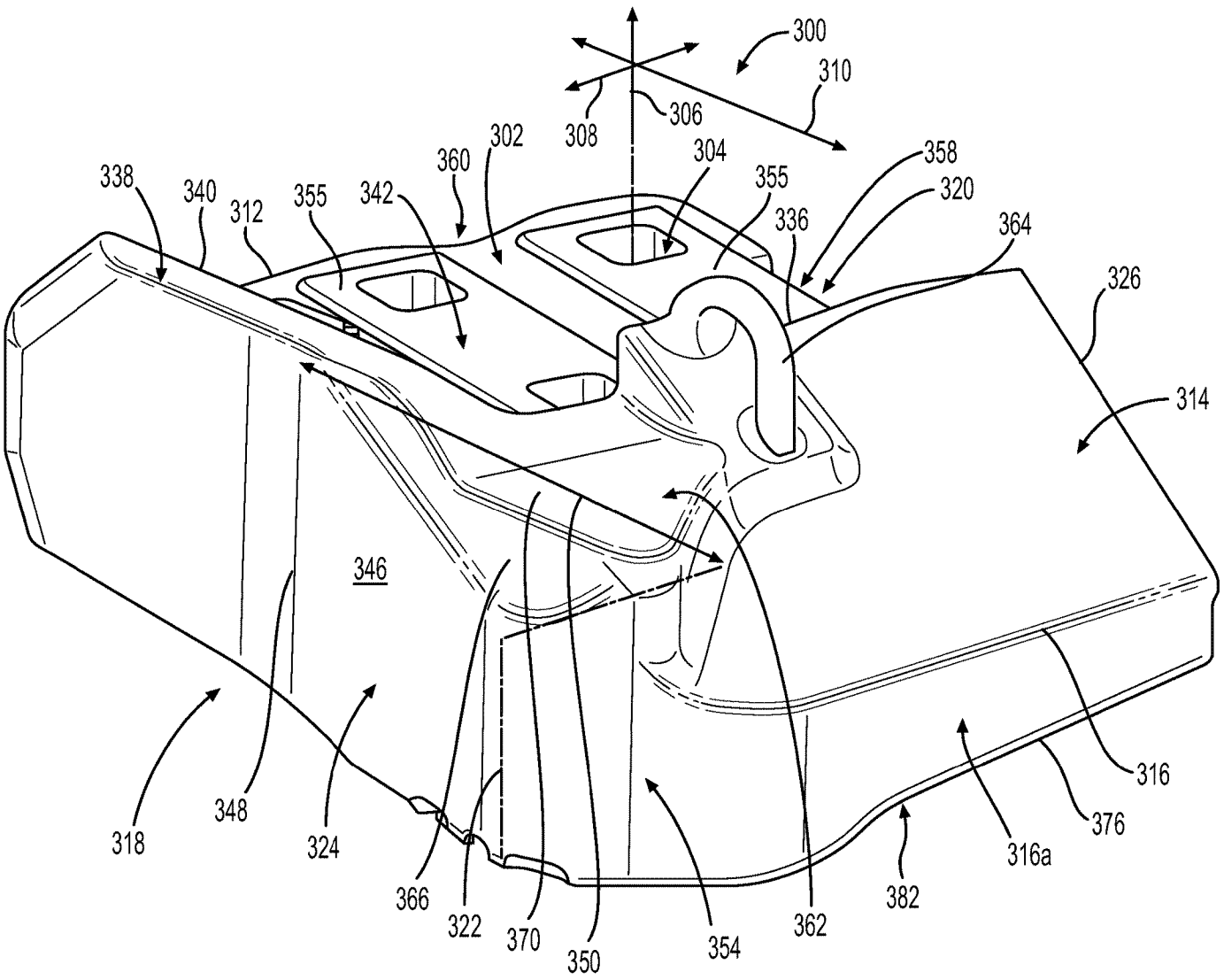
FIG. 6 is a left side, and top oriented perspective view of the left hand corner guard of FIG. 5.

Looking at FIGS. 3, 5, and 6 together, the corner guard 300 may comprise a rear attachment portion 302 defining a first fastener receiving void 304 that defines a central axis. This central axis may be coincident with a vertical direction of assembly 306 (so called since this is the direction the fasteners must extend to attach the corner guard 300 to the base edge 202 in order to abut the base edge and protect it). Also, a lateral direction 308 may extend perpendicularly o the vertical direction of assembly 306, while a direction of material flow 310 (so called since this is the general direction in which material flows into and out of the bucket) extends perpendicularly to the vertical direction of assembly 306, and the lateral direction 310.

The corner guard may include a rear edge 312 that is disposed along the direction of material flow 310, as well as a forward ramp portion 314 (may also be referred to as a forward wear portion) that extends forwardly from the rear attachment portion 302 along the direction of material flow 310, and vertically downwardly forming a front wear edge 316.

Similarly, an outer lateral side 318 (so called since it faces laterally away from the interior of the bucket), and an inner lateral side 320 (so called since it faces laterally toward the interior of the bucket) may be disposed in an opposing manner along the lateral direction 308. The outer lateral side 318 may be flared laterally, defining an outer lateral side extremity 322 that is disposed along the direction of material flow 310 adjacent to the front wear edge 316. This arrangement forms a flared portion 324.

On the other hand, the inner lateral side 320 may include a first planar surface 326 that is oblique to the lateral direction 308. This may not be the case in other embodiments of the present disclosure.

As best seen in FIG. 3, the flared portion 324 may define an acute included flare angle 328 with the front wear edge 316 in a plane that is perpendicular to the vertical direction of assembly 306 that may range from 70.0 degrees to 80.0 degrees (e.g., 75.0 degrees). In some applications, this range may be altered.

Figure 9:
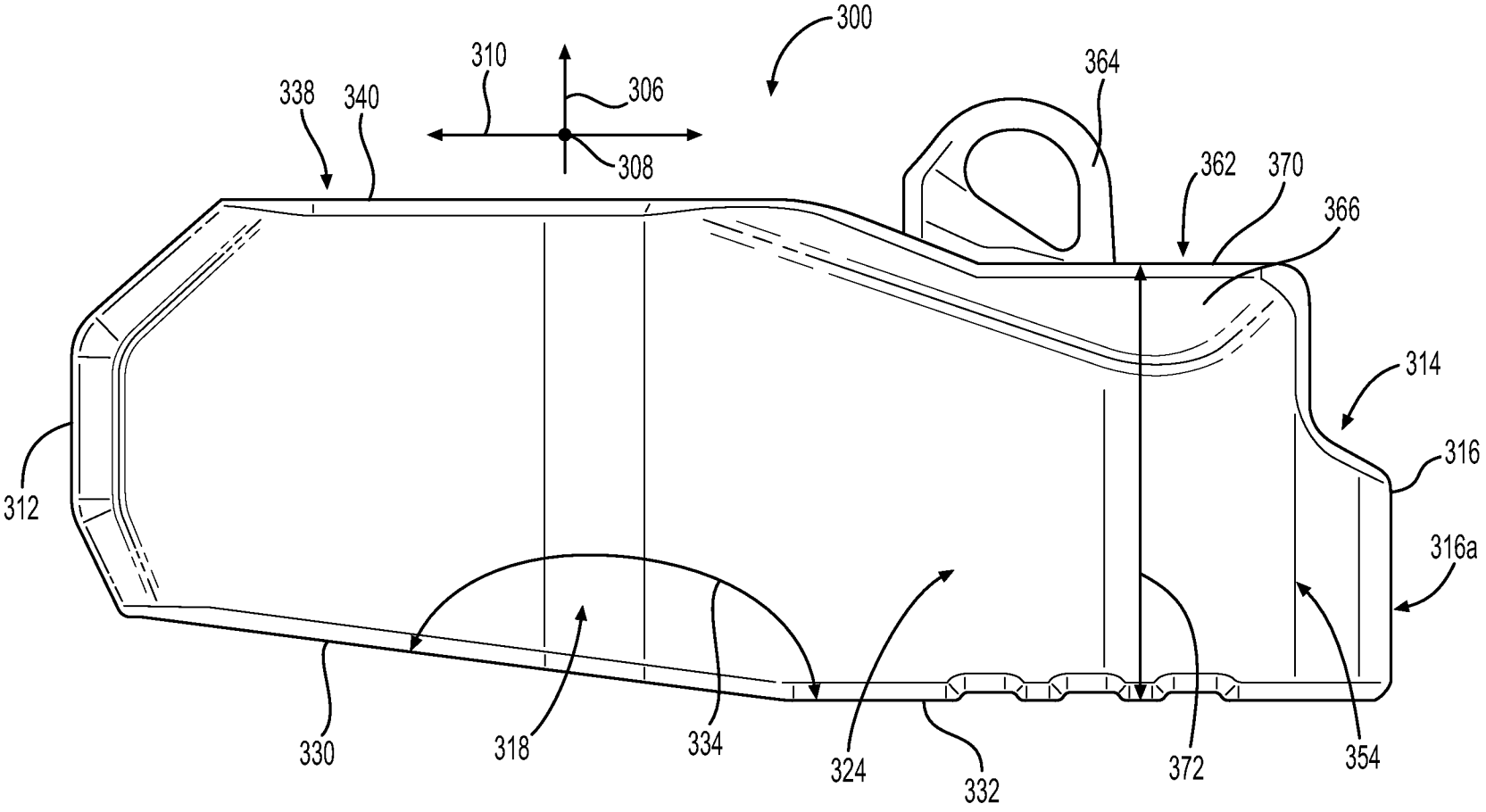
FIG. 9 is a left side view of the left hand corner guard of FIGS. 5 and 6.

Referring now to FIG. 9, it can be seen that the corner guard 300 may further comprise a bottom angled surface 330 that extends from the rear edge 312 to the flared portion 324, terminating in a bottom flat surface 332. In some embodiments, the bottom angled surface 330 forms an obtuse included angle 334 with the bottom flat surface 332 in a plane that is perpendicular to the lateral direction 308 that ranges from 170.0 degrees to 180.0 degrees. More particularly, this angle 334 may range from 172.5 degrees to 177.5 degrees (e.g. 175.0 degrees).

In FIGS. 5 and 6, it may be understood that the forward ramp portion 314 may define a ramp top edge 336 that is disposed vertically above the rear attachment portion 302. Also, the outer lateral side 318 may include a lateral sidewall 338 that extends rearwardly along the direction of material flow 310 from the flared portion 324 toward the rear edge 312. The lateral sidewall 338 may define a lateral sidewall top edge 340 that is also disposed vertically above the rear attachment portion 302, at least partially defining a pocket 342 disposed above the rear attachment portion 302. This pocket may be configured to receive a portion of the base edge during assembly (e.g., see FIG. 3).

The corner guard 300 may also define a maximum length 344 measured along the direction of material flow 310. The flared portion 324 includes a sloped surface 346 including a rear intersection 348 with the lateral sidewall 338, and that extends adjacent to the outer lateral side extremity 322. A flare length 350 may be measured along the direction of material flow 310 from the rear intersection 348 of the sloped surface 346 to the outer lateral side extremity 322.

Figure 8:
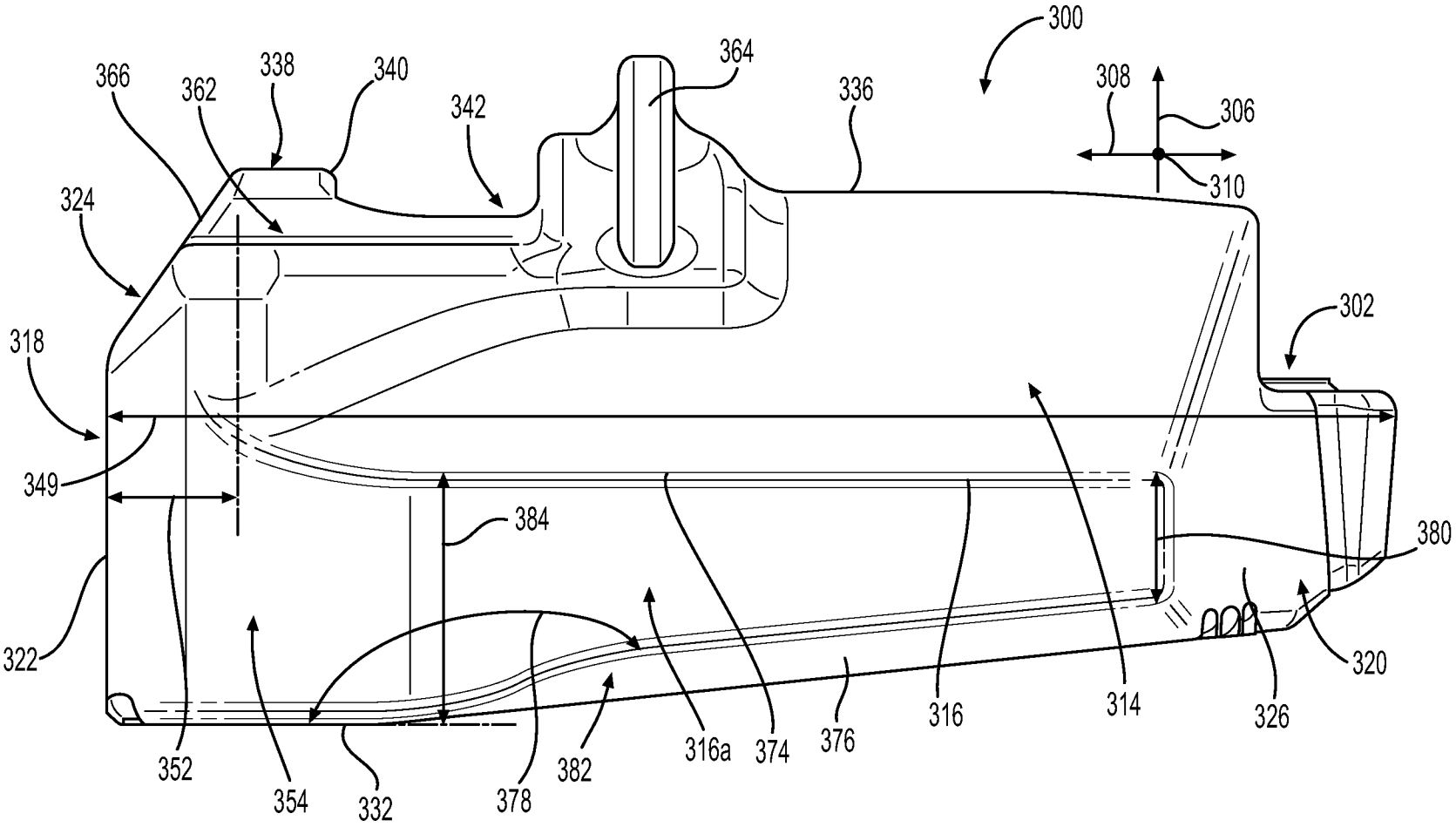
FIG. 8 is a front view of the left hand corner guard of FIGS. 5 and 6.

Likewise in FIG. 8, the corner guard 300 may define a maximum width measured 349 along the lateral direction 308, and the flared portion 324 may define a flare width 352 measured along the lateral direction 308 from the outer lateral side extremity 322 to the lateral sidewall 338.

In some embodiments, a ratio of the maximum length to the flare length ranges from 1.5 to 2.5, and a ratio of the maximum width 349 to the flare width 352 may range from 8.0 to 10.0.

Also as best seen in FIG. 3, the outer lateral side extremity 322 may be connected to the front wear edge 316 by a convex arcuate surface 354 (this surface may include one or bowed portions or tangential surfaces comprising various geometric entities including radius, a series of radii, a polynomial, a spline, an ellipse, etc.). In specific embodiments, the flare width 352 may range from 35.0 mm to 45.0 mm (e.g., 40.0 mm), the flare length 350 may range from 150.0 mm to 160.0 mm (e.g. 155.0 mm), and the convex arcuate surface 354 may define a convex radius of curvature R354 in a plane that is perpendicular to the vertical direction 306 of assembly. These ranges may be altered depending on the material being worked on in the mine, etc.

Referring once more to FIGS. 5 and 6, the rear attachment portion 302 may include a plurality of rectangularly shaped fit pads 355, a recess 356 disposed adjacent a corner of the pocket 342, a side recess 358 that is at least partially defined by the first planar surface 326, and a rear recess 360 that is disposed along the rear edge 312.

The pads 355 help to mate the corner guard to the base edge, while recess 356 is provided to core out material to help avoid voids and porosity during the casting process. A similar recess 356*a* is provided on the bottom (see FIG. 7). The side recess 358, and the rear recess 360 may act as pry slots to help disassembly.

Other features include a side guard resting pad 362 (see also FIGS. 3 and 4, so called since the side guard overhangs this pad and may contact or nearly contact it in some embodiments) disposed laterally adjacent the flared portion 324, a lifting hook portion 364 disposed laterally between the side guard resting pad 362, and the forward ramp portion 314, and a beveled surface 366 joining the flared portion 324 to the lateral sidewall 338, and the side guard resting pad 362. The beveled surface 366 may be oblique to the vertical direction of assembly 306, the lateral direction 308, the direction of material flow 310, and the sloped surface 346. This may not be the case in other embodiments of the present disclosure. One or more of the features just discussed may be omitted or altered in other embodiments of the present disclosure.

Looking at FIGS. 6 and 9, another embodiment of the corner guard 300 may be described as follows. The outer lateral side 318 may flare laterally, and be enlarged vertically from the rear edge 312 toward the front wear surface 316*a*, forming a front flared portion (see 324) disposed proximate to the front wear surface 316*a*. This arrangement may define a bottom flat surface 332, and a flat top surface 370 disposed proximate to a front outer corner of the corner guard 300.

Focusing on FIG. 9, the corner guard 300 may define a vertical distance 372 from the bottom flat surface 332 to the flat top surface 370 that may range from 100.0 mm to 150.0 mm. More particularly, the vertical distance 372 may range from 120.0 mm to 140.0 mm (e.g., 130.0 mm).

In FIG. 8, the front wear surface 316*a* a top lateral edge 374, and a bottom sloping surface 376 extending from the bottom flat surface 332, forming an obtuse included angle 378 with the bottom flat surface 332 in a plane that is perpendicular to the direction of material flow 310 that ranges from 170.0 degrees to 180.0 degrees. More particularly, this angle 378 may range from 172.5 degrees to 177.5 degrees (e.g., 175.0 degrees). Other ranges may be possible in other embodiments depending on the application.

Referring back to FIGS. 6 and 9, the outer lateral side 318 may be flared laterally and enlarged vertically to the bottom flat surface 332, and the bottom sloping surface 376 may extend to the inner lateral side 320. In FIG. 8, a minimum vertical distance 380 from the bottom sloping surface 376 to the top lateral edge 374 (may be near or at the inner lateral surface 320) may range from 40.0 mm to 60.0 mm (e.g., 50.0 mm) in some embodiments.

Figure 7:
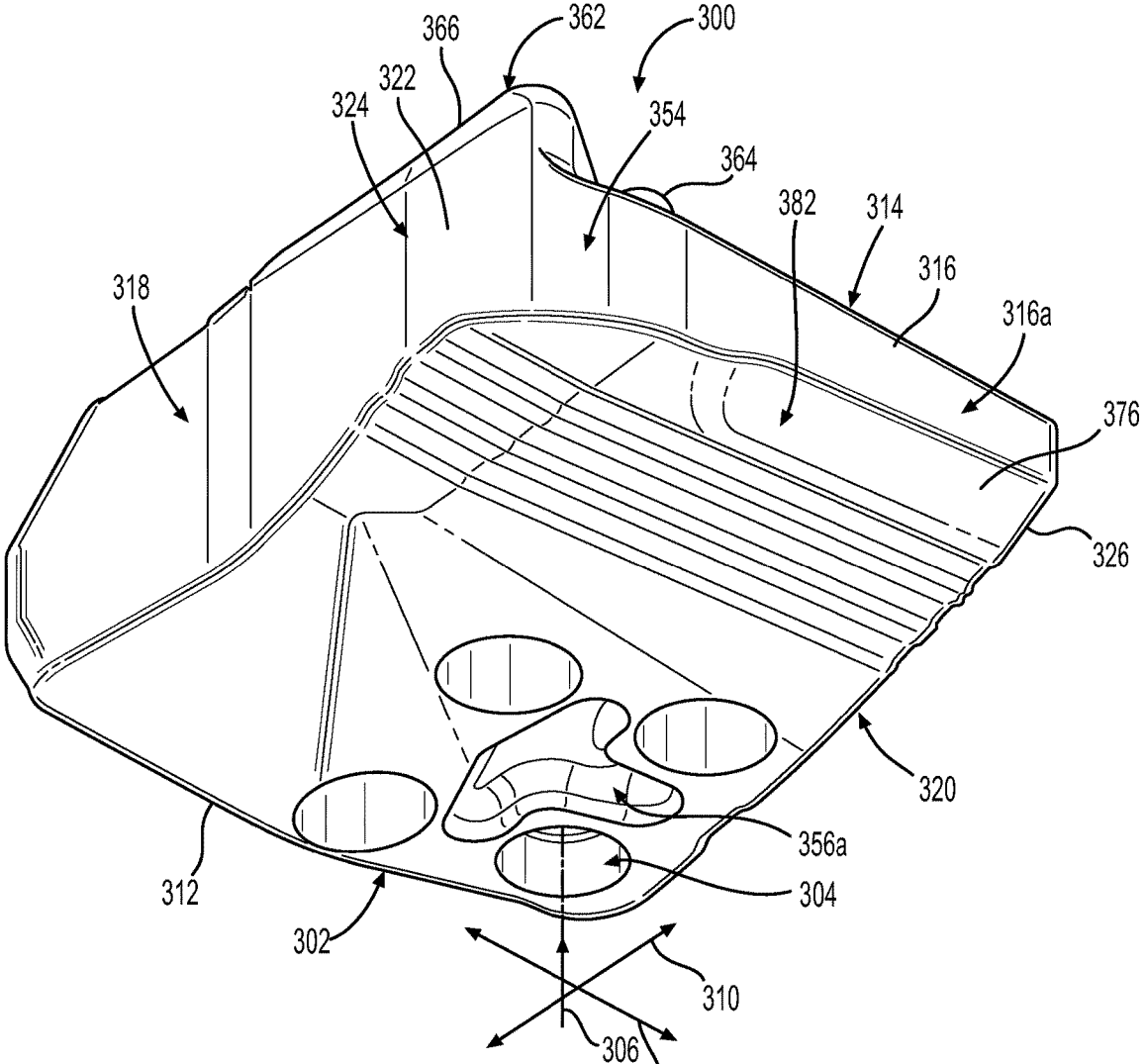
FIG. 7 is a bottom oriented perspective view of the left hand corner guard of FIGS. 5 and 6.

Put another way while looking at FIGS. 7 and 9, the front wear surface 316*a* extends laterally from the outer lateral side 318 to the inner lateral side 320. A bottom flat surface 332 may extend from the outer lateral side 318 toward the inner lateral side 320. A bottom pocket 382 may be provided with a bottom sloping surface 376 that extends from adjacent the bottom flat surface 332 laterally toward the inner lateral side 320. This may not be the case for other embodiments of the present disclosure.

As seen in FIG. 8, the front wear surface 316*a* may define a minimum vertical thickness 380 measured at the inner lateral side 320, and a maximum vertical thickness 384 measured from the bottom flat surface 332 to a top edge (see 374) that extends laterally. A ratio of the maximum vertical thickness 384 to the minimum vertical thickness 380 may range from 1.50 to 2.0 in some embodiments of the present disclosure.

Figure 10:
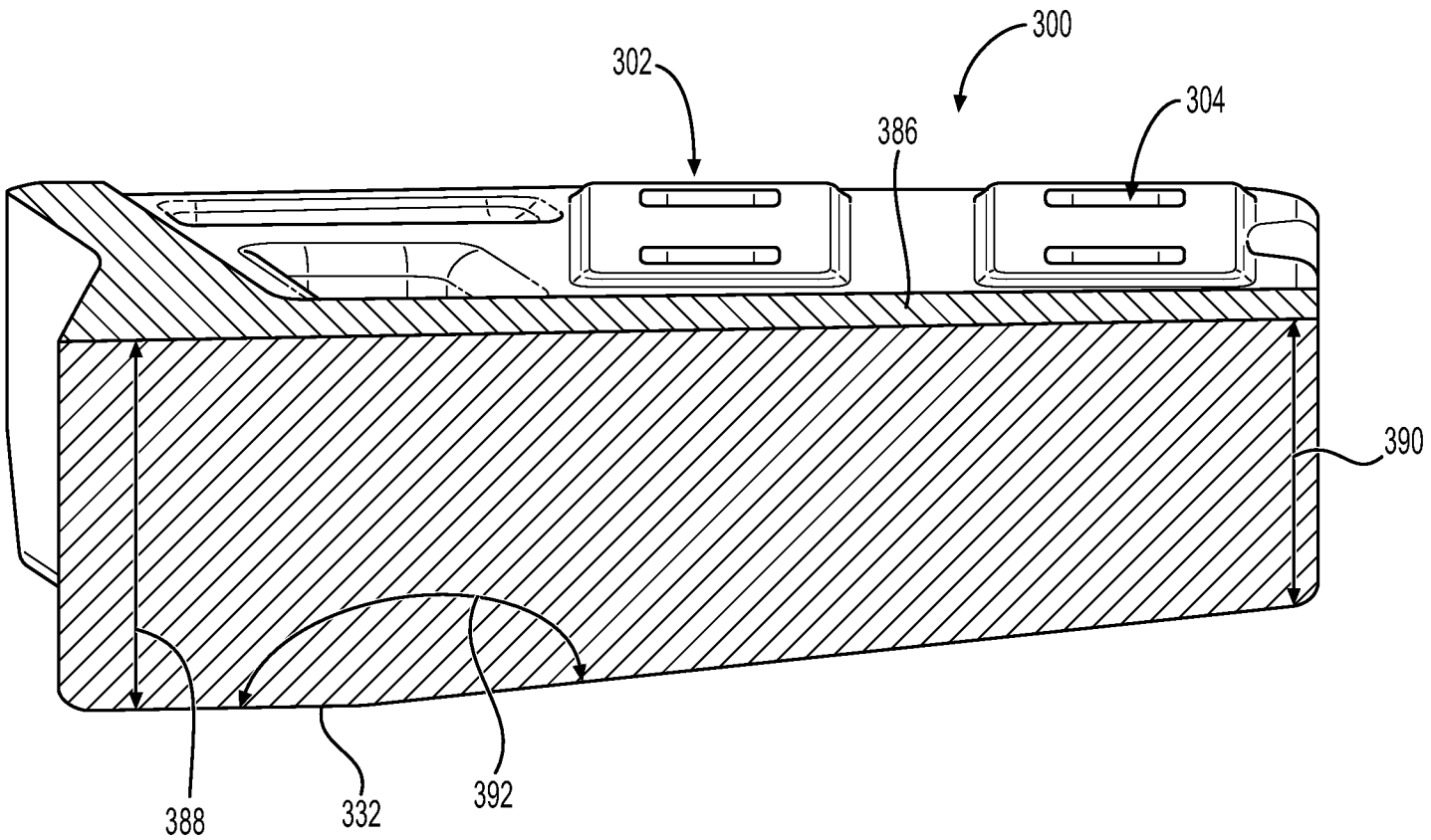
FIG. 10 is a front sectional view of the left hand corner guard of FIGS. 5 and 6 taken along lines 10-10 thereof. Also, the left hand corner guard is sectioned vertically at a plane even with the top surface of the fit pads, removing the top portion of the left hand corner guard.

In FIG. 10, it may be understood that in a plane that is oblique to the direction of material flow, and that separates the rear attachment portion 302 from the forward ramp portion 314, the bottom flat surface 332 may be spaced away from a top planar surface 386 of the rear attachment portion 302 a first predetermined vertical distance 388, while the bottom sloping surface may be spaced away from the top planar surface a second predetermined vertical distance 390 in the plane that is less than the first predetermined distance 388. Moreover, the bottom slopping surface 376 forms an angle 392 in the plane with the bottom flat surface 332 that ranges from 170.0 degrees to 180.0 degrees in some embodiments of the present disclosure. More specifically, this angle 368 may range from 172.5 degrees to 177.5 degrees (e.g., 175.0 degrees).

A ratio of the first predetermined vertical distance 388 to the second predetermined vertical distance 390 may range from 1.25 to 1.4 in some embodiments of the present disclosure. In such a case, the first predetermined vertical distance ranges from 95.0 mm to 105.0 mm (e.g., 100.0 mm), and the second predetermined vertical distance ranges from 70.0 mm to 80.0 mm (e.g., 75.0 mm).

Again, it should be noted that any of the dimensions, angles, surface areas and/or configurations of various features may be varied as desired or needed including those not specifically mentioned herein. Although not specifically discussed, blends such as fillets are shown to connect the various surfaces. These may be omitted in other embodiments and it is to be understood that their presence may be ignored sometimes when reading the present specification unless specifically mentioned.

INDUSTRIAL APPLICABILITY

In practice, a machine, a work implement assembly, a front edge assembly, a corner guard, or any component thereof may be manufactured, bought, or sold to retrofit a machine or a work implement assembly in the field in an aftermarket context, or alternatively, may be manufactured, bought, sold or otherwise obtained in an OEM (original equipment manufacturer) context.

Any of the aforementioned components may be made from any suitable material including iron, grey-cast iron, steel, etc.

Various features of the corner guard may have the following performances. First, as seen in FIG. 4, a vertical offset distance 210 (e.g., about 10.0 mm) may be provided so that the corner guard 300 helps to protect the center guards 204.

It should also be noted that the lateral thickness of the lateral sidewall has been minimized (e.g., half of previous lateral sidewalls) while the flare portion has been increased to maximize material where wear most often occurs. This has been verified through testing and wear simulations, etc.

To that end, a larger convex arcuate surface has been provided than previously possible to maximize and even out the wear in the front outer corner of the corner guard.

The corner guard may increase its useful life by 25% to 50%, or more than previous designs.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A corner guard for protecting a base edge comprising:

a rear attachment portion defining a first fastener receiving void, a vertical direction of assembly, a lateral direction that is perpendicular to the vertical direction of assembly, and a direction of material flow that is perpendicular to the vertical direction of assembly and the lateral direction, and including a rear edge disposed along the direction of material flow;

a forward ramp portion that extends forwardly from the rear attachment portion along the direction of material flow, and vertically downwardly forming a front wear edge, and the ramp top portion including a ramp top edge; and an outer lateral side; and an inner lateral side;

wherein the outer lateral side is convex flared laterally, defining an outer lateral side extremity that is disposed along the direction of material flow adjacent to the front wear edge, and forming a flared portion;

wherein the outer lateral side extremity is closer to the front wear edge than to the rear edge in the direction of material flow; and wherein the flared portion includes a sloped surface extending in the direction of material flow from a location that is forward of the ramp top edge to a location that is rearward of the ramp top edge.

2. The corner guard of claim 1, wherein the inner lateral side includes a first planar surface that is oblique to the lateral direction.

3. The corner guard of claim 2, wherein the flared portion defines an acute included flare angle with the front wear edge in a plane that is perpendicular to the vertical direction of assembly that ranges from 70.0 degrees to 80.0 degrees, and the corner guard further comprises a bottom angled surface extending from the rear edge to the flared portion, terminating in a bottom flat surface, and the bottom angled surface forms an obtuse included angle with the bottom flat surface in a plane that is perpendicular to the lateral direction that ranges from 170.0 degrees to 180.0 degrees.

4. The corner guard of claim 2, wherein the ramp top edge is disposed vertically above the rear attachment portion, and the outer lateral side includes a lateral sidewall that extends rearwardly along the direction of material flow from the flared portion, the lateral sidewall defining a lateral sidewall top edge that is also disposed vertically above the rear attachment portion, at least partially defining a pocket disposed above the rear attachment portion.

5. The corner guard of claim 4, wherein the corner guard defines a maximum length measured along the direction of material flow, the sloped surface including a rear intersection with the lateral sidewall, and that extends to the outer lateral side extremity, and defines a flare length measured along the direction of material flow from the rear intersection of the sloped surface to the outer lateral side extremity.

6. The corner guard of claim 5, wherein the corner guard defines a maximum width measured along the lateral direction, and the flared portion defines a flare width measured along the lateral direction from the outer lateral side extremity to the lateral sidewall.

7. The corner guard of claim 6, wherein a ratio of the maximum length to the flare length ranges from 1.5 to 2.5, and a ratio of the maximum width to the flare width ranges from 8.0 to 10.0, and the outer lateral side extremity is connected to the front wear edge by a convex arcuate surface.

8. The corner guard of claim 7, wherein the flare width ranges from 35.0 mm to 45.0 mm, the flare length ranges from 150.0 mm to 160.0 mm, and the convex arcuate surface defines a convex radius of curvature in a plane that is perpendicular to the vertical direction of assembly.

9. The corner guard of claim 4, wherein the rear attachment portion includes a plurality of rectangularly shaped fit pads, a recess disposed adjacent a corner of the pocket, a side recess that is at least partially defined by the first planar surface, and a rear recess disposed on the rear edge.

10. The corner guard of claim 9, further comprising a side guard resting pad disposed laterally adjacent the flared portion, a lifting hook portion disposed laterally between the side guard resting pad and the forward ramp portion, and a beveled surface joining the flared portion to the lateral sidewall and to the side guard resting pad.

11. A corner guard for protecting a base edge comprising:

a rear attachment portion defining a first fastener receiving void, a vertical direction of assembly, a lateral direction that is perpendicular to the vertical direction of assembly, and a direction of material flow that is perpendicular to the vertical direction of assembly and the lateral direction, and including a rear edge disposed along the direction of material flow;

a forward ramp portion that extends forwardly from the rear attachment portion along the direction of material flow, and vertically downwardly forming a front wear edge including a front wear surface; and an outer lateral side; and an inner lateral side;

wherein the outer lateral side is flared laterally, and enlarged vertically from the rear edge toward the front wear surface, forming a front flared portion including a convex arcuate surface disposed proximate to the front wear surface and protruding in the lateral direction, and defining a bottom flat surface and a flat top surface disposed proximate to a front corner of the corner guard and a bottom sloping surface extending from the bottom flat surface;

wherein the outer lateral side is enlarged vertically to the bottom flat surface, and the bottom sloping surface extends to the inner lateral side; and wherein the front wear surface includes a top lateral edge, and the bottom sloping surface forms an obtuse included angle with the bottom flat surface in a plane that is perpendicular to the direction of material flow that ranges from 170.0 degrees to 180.0 degrees.

12. The corner guard of claim 11, wherein the corner guard defines a vertical distance from the bottom flat surface to the flat top surface ranging from 100.0 mm to 150.0 mm.

13. The corner guard of claim 11, wherein a minimum vertical distance from the bottom sloping surface to the top lateral edge ranges from 40.0 mm to 60.0 mm.

14. A corner guard for protecting a base edge comprising:

a rear attachment portion defining a first fastener receiving void, a vertical direction of assembly, a lateral direction that is perpendicular to the vertical direction of assembly, and a direction of material flow that is perpendicular to the vertical direction of assembly and the lateral direction, and including a rear edge disposed along the direction of material flow;

a forward ramp portion that extends forwardly from the rear attachment portion along the direction of material flow, and vertically downwardly forming a front wear surface; and an outer lateral side; and an inner lateral side;

wherein the front wear surface extends laterally, and further comprising a bottom flat surface that extends from the outer lateral side toward the inner lateral side, and a bottom pocket including a bottom sloping surface that extends from adjacent the bottom flat surface laterally toward the inner lateral side and is continuously sloped upward from adjacent the bottom flat surface to the inner lateral side, and the bottom flat surface extends in the lateral direction between the pocket and the outer lateral side, and extends in the direction of material flow to a location that is rearward of the pocket.

15. The corner guard of claim 14, wherein the front wear surface defines a minimum vertical thickness measured at the inner lateral side, and a maximum vertical thickness measured from the bottom flat surface to a top edge that extends laterally, and a ratio of the maximum vertical thickness to the minimum vertical thickness 1.50 to 2.0.

16. The corner guard of claim 14, wherein in a plane that is oblique to the direction of material flow that separates the rear attachment portion from the forward ramp portion, the bottom flat surface is spaced away from a top planar surface of the rear attachment portion a first predetermined vertical distance, and the bottom sloping surface forms an angle in the plane with the bottom flat surface that ranges from 170.0 degrees to 180.0 degrees.

17. The corner guard of claim 14, wherein the bottom sloping surface is spaced away from the top planar surface a second predetermined vertical distance in the plane, and a ratio of the first predetermined distance to the second predetermined distance ranges from 1.25 to 1.4.

18. The corner guard of claim 17, wherein the first predetermined distance ranges from 95.0 mm to 105.0 mm, and the second predetermined distance ranges from 70.0 mm to 80.0 mm.

* * * * *